United States Patent [19]

Jones

[11] Patent Number: 4,991,773

[45] Date of Patent: Feb. 12, 1991

[54] METHOD AND APPARATUS FOR DISSIPATING FOG

[76] Inventor: Darrell R. Jones, 7515 N. Fessenden, Portland, Oreg. 97203

[21] Appl. No.: 325,136

[22] Filed: Mar. 17, 1989

[51] Int. Cl.[5] ..... E01H 13/00

[52] U.S. Cl. ..... 239/2.1; 239/14.1; 98/1

[58] Field of Search ..... 239/2.1, 14.1; 98/1, 98/40.01, DIG. 1; 244/114

[56] References Cited

U.S. PATENT DOCUMENTS

| | | | |
|---|---|---|---|
| 1,793,719 | 2/1931 | Reader . | |
| 2,570,226 | 10/1951 | Geiringer | 239/2.1 X |
| 2,693,140 | 11/1954 | Minton . | |
| 2,815,982 | 12/1957 | Bleamaster . | |
| 3,118,604 | 1/1964 | Bertin et al. . | |
| 3,196,822 | 7/1965 | Bertin et al. . | |
| 3,263,979 | 8/1966 | Muckelrath . | |
| 3,501,096 | 3/1970 | Stilwell et al. . | |
| 3,603,507 | 9/1971 | Devlin . | |
| 3,712,542 | 1/1973 | Price, Jr. . | |
| 4,125,223 | 11/1978 | Carver et al. . | |
| 4,316,406 | 2/1982 | Lind | 48/40.01 |
| 4,644,683 | 2/1987 | Jones . | |

OTHER PUBLICATIONS

"Navy Proving Base Trying Out All Fog Dispersing Systems", Scholer Bangs, Dec. 3, 1945, "Aviation News", p. 12.

*Primary Examiner*—Andres Kashnikow
*Assistant Examiner*—William Grant
*Attorney, Agent, or Firm*—Marger, Johnson, McCollom & Stolowitz, Inc.

[57] ABSTRACT

A method and apparatus for dissipating fog. A low enclosure includes a plurality of slits in the top thereof. A space heater is in communication with the enclosure and provides a flow of heated air thereinto. Heat is transferred to the air above the enclosure by convection through the slits and by radiation from the heated top. A plurality of such enclosures are positioned adjacent a runway to evaporate fog in the air surrounding the runway.

29 Claims, 3 Drawing Sheets

METHOD AND APPARATUS FOR DISSIPATING FOG

BACKGROUND OF THE INVENTION

1. Field of the Invention

This invention pertains to methods and apparatus for dissipating fog and more particularly to such methods and apparatus which heat the air thereby evaporating fog.

2. Description of the Related Art

When fog at an airport reduces visibility to the extent that airplanes cannot land and take off, costly delays of freight and passengers occur. It is known that heating fog-laden air increases the capacity of the air for holding water vapor and thus evaporates the fog.

Prior art apparatus for heating the air to evaporate fog and thus increase visibility are known. One such apparatus is disclosed in U.S. Pat. No. 4,125,223 to Carver et al. for an Air Field Space Heater For Fog Dispersal System. The Carver et al. system comprises a space heater which directs streams of hot air across a runway. A similar system to Bertin et al. in U.S. Pat. No. 3,196,822 generates streams of hot air which are directed across the deck of an aircraft carrier.

Other prior art systems utilize heated air which rises by convection. In one such system, a line of small, closely spaced burners are provided to create a row of heat sources.

All of the foregoing suffer from several disadvantages. Primarily, the prior art devices are not able to heat a sufficient volume of air to create adequate visibility for aircraft operations. Secondary problems relate to the length of time necessary to clear fog and the economics of constructing and using such devices. Some of the devices utilize open flames and therefore present safety hazards. In addition, some are not remotely controllable.

SUMMARY OF THE INVENTION

A method for dissipating fog includes the step of generating a flow of heated air. Such air is distributed over a substantially horizontal surface and is confined to a relatively small volume immediately adjacent the horizontal surface. The confined heated air is permitted to rise upwardly thereby heating the ambient air and evaporating moisture therein.

The present invention also encompasses apparatus for performing these steps of the method.

It is a general object of the present invention to provide a method and apparatus for dissipating fog which overcomes the above-enumerated disadvantages associated with prior art methods and apparatus.

It is a more specific object of the present invention to provide such a method and apparatus which rapidly and economically dissipates fog from a relatively large volume of ambient air.

It is another specific object to provide such a method and apparatus which does not utilize open flames and which is remotely controllable, e.g., from an airport control tower.

The foregoing and other objects, features and advantages of the invention will become more readily apparent from the following detailed description of a preferred embodiment which proceeds with reference to the drawings.

DETAILED DESCRIPTION OF THE PREFERRED EMBODIMENTS

Figure 1:
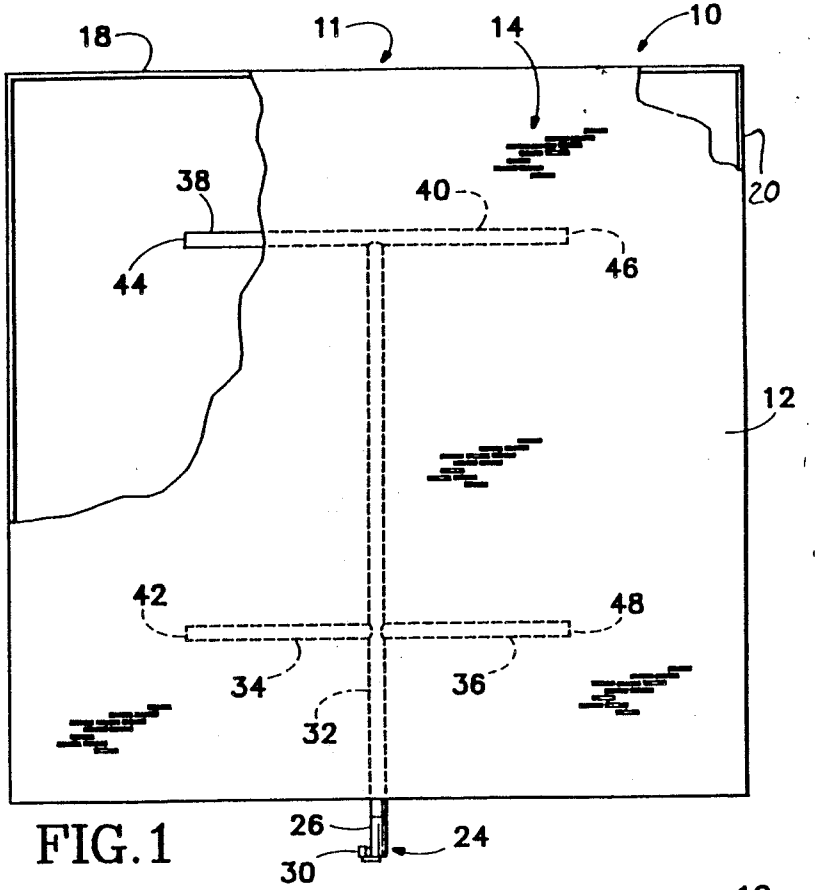
FIG. 1 is a top plan view of an air-heating unit, with portions thereof broken away to view interior structure, constructed in accordance with the present invention.
Figure 2:
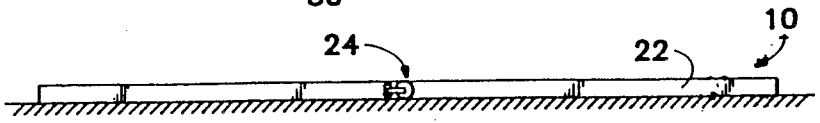
FIG. 2 is a front elevation view of the air-heating unit of FIG. 1.
Figure 3:
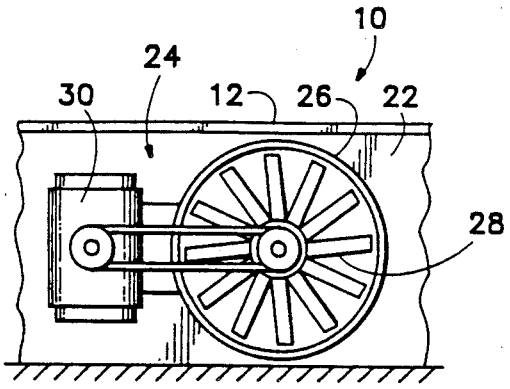
FIG. 3 is an enlarged partial view of a portion of the air-heating unit of FIG. 2.

Indicated generally at 10 in FIGS. 1, 2 and 3 is an air-heating unit constructed in accordance with the present invention. An enclosure 11 includes a planar member or top 12 which, in the present embodiment of the invention, is substantially planar and square-shaped. In the present embodiment of the invention, top 12 measures 100 feet on each side and includes a plurality of elongate openings or slits, which are indicated generally at 14. It is to be appreciated that slits 14 are distributed uniformly over top 12, although this is not shown in the drawing for the purpose of illustrating other components in air-heating unit 10. Also, portions of top 12 are broken away to disclose structure there beneath.

Enclosure 11 also includes a side or side member made up of four side panels 16, 18, 20, 22. Each of the side panels are substantially identical to one another and, in the present embodiment of the invention, are each two feet high by 100 feet long and are connected to form a square 100 feet×100 feet with top 12 resting on the upper edges of each of the side panels.

Top 12 in combination with side panels 16, 18, 20, 22 define an enclosed space.

Each side panel has 200 square feet of surface area for a total of 800 square feet for all of the side panels combined. Top 12 has 10,000 square feet in the present embodiment of the invention. As will be hereinafter discussed, it is preferable to maintain the total surface area of the side panels to less than 10% of the top surface area in order to realize desirable operating efficiencies.

Indicated generally at 24 is a heater. Heater 24 is also referred herein as means for generating a flow of heated air. Heater 24 is constructed and operates in accordance with the disclosure of U.S. Pat. No. 4,644,683 to Jones which is incorporated herein by reference.

Generally speaking, heater 24 includes a tubular housing 26. A fan 28 is coaxially mounted on the outer end of housing 26 and is oriented to draw air into the housing when the fan rotates. A motor 30 is mounted on one side of housing 26 for driving fan 28.

A propane burner (not visible) is received within housing 26 adjacent fan 28. When propane flowing through the burner is ignited, and motor 30 is energized to turn fan 28, a flow of heated air is directed from housing 26 into a duct 32 to which the housing is connected.

In this embodiment of the invention, the heater is capable of producing between approximately 2 million to approximately 10 million B.T.U. per hour and has an airflow rate of approximately 10,000 cubic feet per minute to approximately 100,000 cubic feet per minute. The exhaust gas temperature is variable between approximately 800° F. and 2,000° F. The heater output is varied by proportionately increasing or decreasing both the air volume, by increasing or decreasing the speed of fan 28, and the amount of propane provided to the burner, by increasing or decreasing the propane supply pressure.

Duct 32 extends from housing 26 through a circular hole in side panel 22 which is just large enough to receive the duct therethrough. The space between the radially outer surface of duct 32 and the hole in side panel 22 includes an air-tight seal to prevent leakage of air from enclosure 11.

Branches 34, 36, 38, 40 extend from either side of duct 32 as shown. Each branch includes an open end 42, 44, 46, 48 from which airflow generated by fan 28 leaves the branch and enters the interior of enclosure 11. The cross-sectional area of duct 32 is referred to herein as a port for communicating a flow of heated air to the enclosed space. In the present embodiment of the invention, the cross-sectional area of duct 32 is greater than the combined area of slits 14. The interior of enclosure 11 is thus not subject to pressures much greater than the ambient atmosphere at the rates of operation of this embodiment of the invention.

Figure 4:
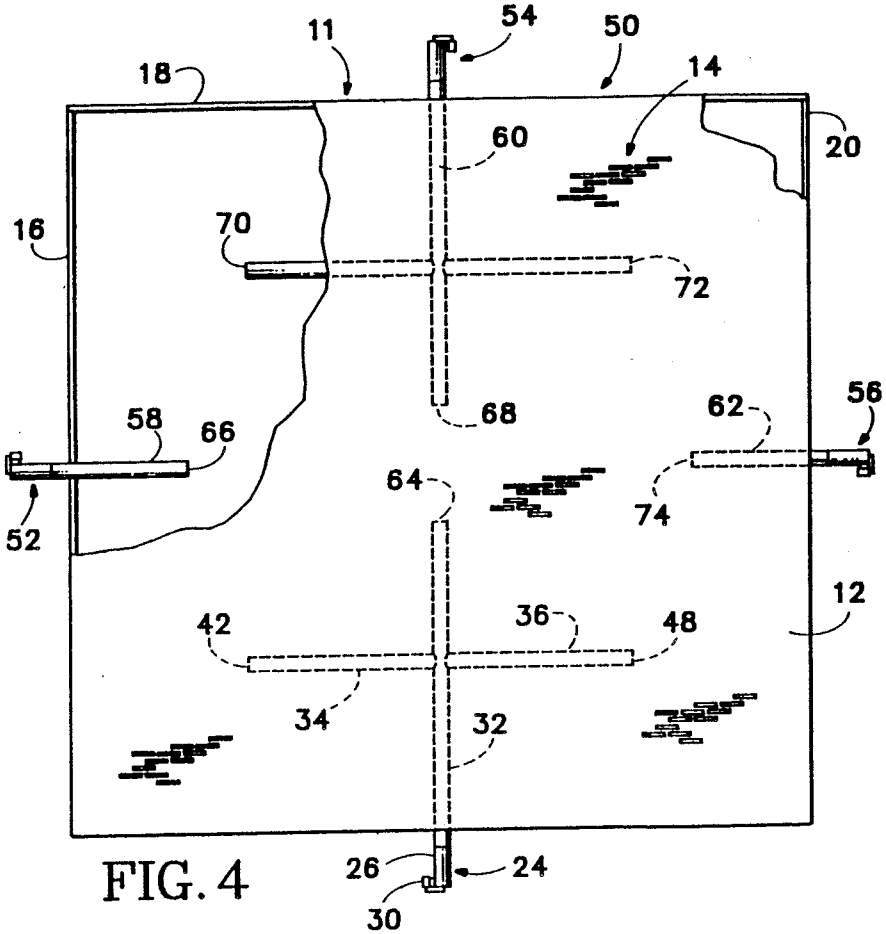
FIG. 4 is a view similar to FIG. 1 of a second air-heating unit constructed in accordance with the present invention.

Directing attention now to FIG. 4, illustrated therein is a second air-heating unit 50 constructed in accordance with the present invention. Structure which has been previously identified and numbered in FIGS. 1–3 and which is substantially identical in the FIG. 4 embodiment is identified by the same numeral.

Also included in air-heating unit 50 are heaters 52, 54, 56. Heaters 52, 54, 56 are substantially identical to heater 24 and are in communication with ducts 58, 60, 62, respectively, which provide means for communicating air from the heaters to the interior of enclosure 11. Each of ducts 58, 60, 62 is received in an opening in the side panel 16, 18, 20, respectively, associated therewith, in the same fashion as duct 32 is received in an opening side panel 22. There is an air-tight seal between the opening and each duct passing therethrough.

Ends 64, 66, 68, 70, 72, 74 communicate air from the ducts and branches inside enclosure 11 to the interior of the enclosure. The combined cross-sectional area of ducts 32, 58, 60, 62 is less than the area of openings 14 in top 12.

Figure 5:
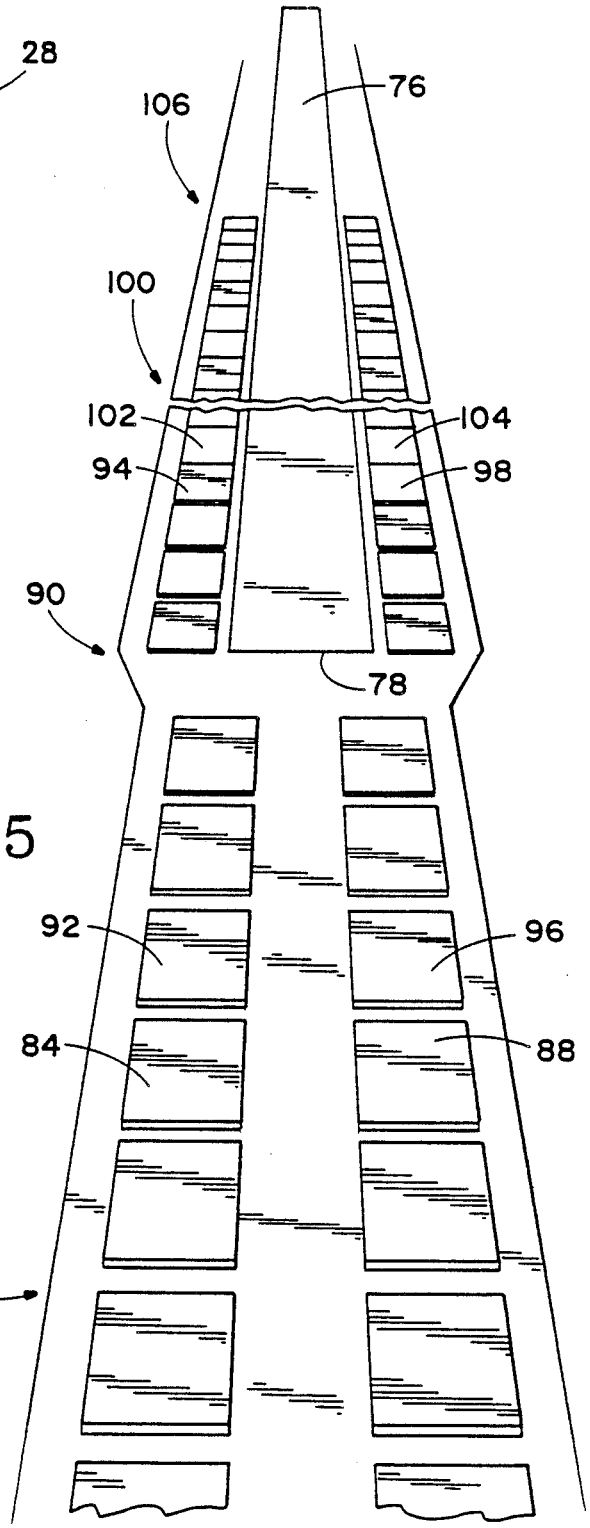
FIG. 5 is a diagrammatic perspective view of an aircraft runway having air-heating units constructed in accordance with the present invention adjacent thereto.
Figure 6:
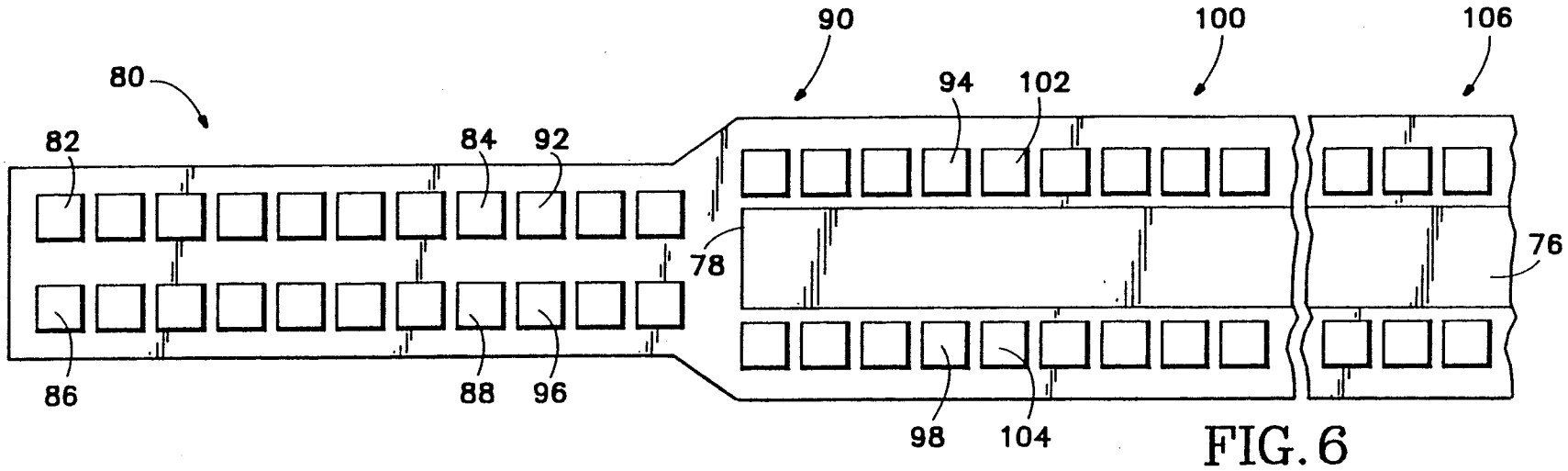
FIG. 6 is a top plan view of the runway and air-heating units of FIG. 5.
Figure 7:
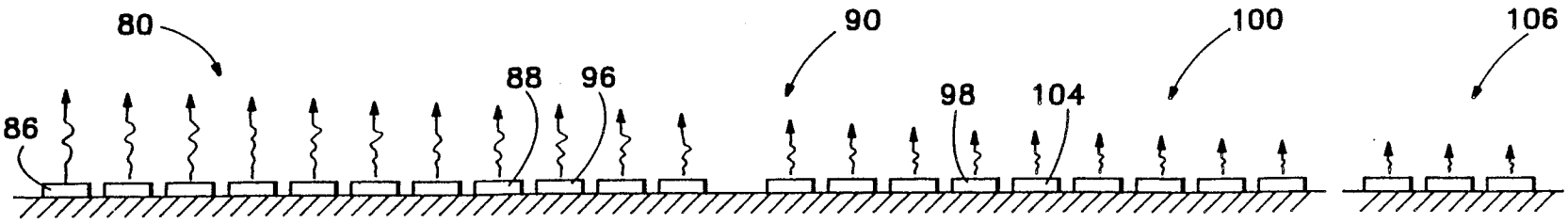
FIG. 7 is an elevation view of the runway and air-heating units of FIG. 6.

Turning now to FIGS. 5, 6 and 7, illustrated therein is an airport runway 76 in combination with a plurality of enclosures constructed in accordance with the present invention. Runway 76 includes an approach end 78 which is the end of the runway that incoming aircraft approach during landing.

Indicated generally at 80 is a first group of air-heating units which includes units 82, 84, and all the units therebetween, and units 86, 88, and all the units therebetween. Each of the air-heating units in group 80 is substantially identical to air-heating unit 50 in FIG. 4 and operates in substantially the same manner.

A second group, indicated generally at 90, of air-heating units includes therein units 92, 94, and the units therebetween, and units 96, 98, and all the units therebetween. Air-heating units in group 90 are similar in structure to air-heating unit 50 but include only three heaters, like heater 24, in communication with ducts, like duct 32, which extend into the interior of the enclosure.

A third group, indicated generally at 100, of air-heating units includes unit 102, and a plurality of air-heating units to the right thereof, and unit 104, and a plurality of air-heating units to the right thereof. Each of the air-heating units in group 100 is similar in structure to air-heating unit 10 except that it includes two heaters, like heater 24, each of which communicates with an associated duct that extends into the enclosure in the same fashion as duct 32.

Indicated generally at 106 is a fourth group of air-heating units each of which are substantially identical to air-heating unit 10 in FIG. 1 with each of the heating units in group 106 including a single heater and an associated duct and branches.

Consideration will now be given to the operation of air-heating unit 10 in FIG. 1. Heater 24 is energized by initiating a flow of propane to the burners (not visible), starting motor 30 (which begins turning fan 28) and igniting the propane at the burners. Thus, a flow of heated air is generated in duct 32 which is provided to branches 34, 36, 38, 40 and which flows into enclosure 11 via branch ends 42, 44, 46, 48. The heated air thus fills enclosure 11 and rises therefrom via openings 14. The heated air in the enclosure heats top 12 which begins to radiate heat. Thus, heat is provided into the atmosphere above the air-heating unit as a result of convection, radiation and some propulsion responsive to the airflow created by fan 28.

It is desirable to maintain a relatively low ratio of the total side panel surface area to top surface area since the object is to distribute the heated air over a large area, then allow it rise. If the ratio is too high, energy is wasted on heating the volume of air in the enclosure. It has been determined that ratios of 10% or less are desirable to achieve the most economical operation.

As the air above the heating unit is so heated, fog droplets begin to evaporate thus increasing visibility in the air.

To clear a large volume of air over and adjacent a runway, a plurality of heating units are arranged in groups, as illustrated in FIGS. 5, 6 and 7, adjacent runway 76. To permit safe landing of aircraft approaching runway 76 from end 78 it is desirable to clear fog from airspace approximately 1,500 feet from end 78 and about 200 feet high to approximately 1,500 feet down the runway from end 78. The cleared distance above the runway should be in the 50 to 100 foot high range and the width along the entire 3,000 feet of cleared space should be approximately 300 feet centered along the axis of runway 76.

The length of the vertical arrows in FIG. 7 is proportional to the amount of heat produced by the associated air-heating unit. The arrow is thus proportional to the altitude of increased-visibility air above the heating unit. As heated air rises, it cools. Thus, if hotter air is produced, it will maintain a higher temperature at a selected altitude above the heating unit than would less heated air.

Since the heating units in group 80 contain four heaters, those air-heating units produce hotter air than the ones in the other groups. As will be recalled, the heat generated by an individual heater can be varied by varying fan speed and the rate at which propane is provided to the burners (which varies in response to propane pressure). Thus, the heat produced by the heating units is set to increase visibility, by evaporating fog droplets, at higher altitudes for the positions at which an approaching aircraft is higher. As the aircraft approaches runway end 78, and thus lowers it altitude, less heat is required to eliminate fog from the (lower) altitudes of interest. On that part of runway 76 downward from the plane touchdown point, the lowest visibility ceilings are permissible and thus the lowest heat is generated by the air-heating units in group 106.

As planes land and take off, the turbulence created thereby further mixes the heated air and enhances the clearing effect.

Such a use of thermal convection and radiation minimizes the energy required to clear air above the air-heating units. The fans, like fan 28, in each of the heaters are not utilized to propel air upwardly, although some of this action occurs, but rather are primarily used to draw air through a heater and to distribute the same throughout the enclosure to permit the air to rise through the slits, like slits 14, by convections.

The present invention thus provides an economical method and apparatus for dissipating fog as well as a safe one since open flames are not utilized. The heaters utilized herein are remotely controllable thus permitting control of the heat output from a remote location such as an airport control tower. The present method and apparatus is likewise quick acting in that large volumes of air can be quickly drawn in and heated, thus enabling clearing of the runway in a relatively short time. It is to be appreciated that air-heating units can be set up on both the ends of a runway, like runway 76, and selected units turned on and adjusted, dependent upon the visibility and ceiling, to permit landings from both ends of the runway.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

I claim:

1. A method for dissipating fog comprising the steps of:

positioning a substantially planar member comprising an enclosure having a top and a side, said side having less than 10% of the area of said top, generally parallel and above a horizontal surface;

creating a plurality of openings in said planar member;

generating a flow of heated air; and directing the heated air beneath said planar member.

2. A method according to claim 1 wherein the step of generating a flow of heated air comprises the steps of:

igniting a burner; and directing a flow of air across the burner.

3. A method according to claim 2 wherein the step of directing a flow of air across the burner comprises the step of generating a flow of air greater than approximately 10,000 cubic feet per minute.

4. A method according to claim 1 wherein the step of generating a flow of heated air comprises the step of heating air at the rate of at least 2,000,000 B.T.U. per hour.

5. Apparatus for dissipating fog comprising:

means for generating a flow of heated air;

an enclosure in fluid communication with the heated airflow and having a top and a side, said side having less than 10% of the surface area of said top; and a plurality of openings formed in said enclosure top.

6. An apparatus according to claim 5 wherein said means for generating a flow of heated air comprises:

a gas burner; and fan means for blowing air across said burner when said apparatus is in operative condition.

7. An apparatus according to claim 6 wherein said fan has a capacity of greater than 10,000 cubic feet per minute.

8. An apparatus according to claim 5 wherein said enclosure is substantially in the shape of a parallelepiped.

9. An apparatus according to claim 5 wherein said apparatus further includes means for distributing the airflow in said enclosure.

10. An apparatus according to claim 5 wherein said means for generating a flow of heated air has a capacity of greater than 2,000,000 B.T.U. per hour.

11. An apparatus according to claim 5 wherein such a flow of heated air is communicated to said enclosure via one or more ports and wherein the combined cross-sectional area of said openings is greater than the combined cross-sectional area of said ports.

12. Apparatus for dissipating fog adjacent an airport runway comprising:

a substantially planar member adjacent said runway and substantially parallel therewith;

a side member disposed about the perimeter of said planar member and in combination therewith defining an enclosed space beneath said planar member, said planar member and side member together being in the shape of a parallelepiped;

means for generating a flow of heated air into said enclosed space; and a plurality of openings formed in said planar member, said enclosed space having a relatively low ratio of the total surface area of the side member to the total surface area of the planar member.

13. An apparatus according to claim 12 wherein said means for generating a flow of heated air comprises:

a gas burner; and fan means for blowing air across said burner when said apparatus is in operative condition.

14. An apparatus according to claim 13 wherein said fan means has a capacity of greater than 10,000 cubic feet per minute.

15. An apparatus according to claim 12 wherein such a flow of heated air is communicated to said enclosed space via one or more ports and wherein the combined cross-sectional area of said openings is greater than the combined cross-sectional area of said ports.

16. An apparatus according to claim 12 wherein said side member has less than 10% of the surface area of said planar member.

17. An apparatus according to claim 12 wherein said apparatus further includes means for distributing the airflow in said enclosure.

18. An apparatus according to claim 12 wherein said means for generating a flow of heated air has a capacity of greater than 2,000,000 B.T.U. per hour.

19. An apparatus according to claim 12 wherein said apparatus further includes a plurality of such enclosed spaces positioned on either side of said runway.

20. An apparatus according to claim 19 wherein said apparatus further includes a plurality of such enclosed spaces positioned on one end of said runway substantially beneath an aircraft runway approach path.

21. Apparatus for dissipating fog comprising:

means for heating air;

a substantially planar member;

a side member disposed about the perimeter of said planar member and in combination therewith defining an enclosed space beneath said planar member, said enclosed space having a relatively low ratio of total surface area of the side member to the total surface area of the planar member;

means for distributing such heated air beneath said planar member for heating the same thereby radiating heat upwardly from said planar member;

a plurality of openings formed in said planar member and substantially uniformly distributed thereover for enabling convection heating of the air above said planar member; and one or more ports for communicating such heated air to said enclosed space, said openings having a combined cross-sectional area greater than the combined cross-sectional area of said ports.

22. An apparatus according to claim 21 wherein said means for heating air comprises:

a gas burner; and fan means for blowing air across said burner when said apparatus is in operative condition.

23. An apparatus according to claim 21 wherein said fan has a capacity of greater than 10,000 cubic feet per minute.

24. An apparatus according to claim 21 wherein said means for heating air has a capacity of greater than 2,000,000 B.T.U. per hour.

25. Apparatus for dissipating fog adjacent an airport runway comprising:

a substantially planar member adjacent said runway and substantially parallel therewith;

a side member disposed about the perimeter of said planar member and in combination therewith defining an enclosed space beneath said planar member;

means for generating a flow of heated air into said enclosed space; and a plurality of openings formed in said planar member, said planar member and side member together are in the shape of a parallelepiped.

26. Apparatus for dissipating fog adjacent an airport runway comprising:

a substantially planar member adjacent said runway and substantially parallel therewith;

a side member disposed about the perimeter of said planar member and in combination therewith defining an enclosed space beneath said planar member;

means for generating a flow of heated air into said enclosed space; and a plurality of openings formed in said planar member, a flow of heated air being communicated to said enclosed space via one or more ports, the combined cross-sectional area of said openings being greater than the combined cross-sectional area of said ports.

27. Apparatus for dissipating fog adjacent an airport runway comprising:

a substantially planar member adjacent said runway and substantially parallel therewith;

a side member disposed about the perimeter of said planar member and in combination therewith defining an enclosed space beneath said planar member, said side member has less than 10% of the surface area of said planar member;

means for generating a flow of heated air into said enclosed space; and a plurality of openings formed in said planar member.

28. Apparatus for dissipating fog comprising:

means for heating air;

a substantially planar member;

a side member disposed about the perimeter of said planar member and in combination therewith defining an enclosed space beneath said planar member, said side member having less than 10% of the surface area of said planar member;

means for distributing such heated air beneath said planar member for heating the same thereby radiating heat upwardly from said planar member; and a plurality of openings formed in said planar member and substantially uniformly distributed thereover for enabling convection heating of the air above said planar member.

29. Apparatus for dissipating fog comprising:

means for heating air;

a substantially planar member;

a side member disposed about the perimeter of said planar member and in combination therewith defining an enclosed space in the shape of a parallelepiped, said enclosed space having a relatively low ratio of total surface area of the side member to the total surface area of the planar member;

means for distributing such heated air beneath said planar member for heating the same thereby radiating heat upwardly from said planar member; and a plurality of openings formed in said planar member and substantially uniformly distributed thereover for enabling convection heating of the air above said planar member.

* * * * *